United States Patent [19]

Adnyana et al.

[11] Patent Number: 4,619,320

[45] Date of Patent: Oct. 28, 1986

[54] SUBSURFACE WELL SAFETY VALVE AND CONTROL SYSTEM

[75] Inventors: Dewa N. Adnyana, Stamford; Neil E. Rogen, Westport, both of Conn.

[73] Assignee: Memory Metals, Inc., Stamford, Conn.

[21] Appl. No.: 585,424

[22] Filed: Mar. 2, 1984

[51] Int. Cl.[4] ..... E21B 34/06

[52] U.S. Cl. ..... 166/65.1; 166/332; 251/11

[58] Field of Search ..... 166/316, 57, 65 R, 72, 166/332, 334, 53, 65.1; 251/11

[56] References Cited

U.S. PATENT DOCUMENTS

| | | | |
|---|---|---|---|
| 1,880,778 | 10/1932 | Byers | 166/57 |
| 1,961,280 | 6/1934 | Crites et al. | 166/316 |
| 3,120,267 | 2/1964 | Bayless | 166/53 |
| 3,179,911 | 4/1965 | Schmitt | 251/11 |
| 3,456,722 | 7/1969 | Cornelius | 166/316 |
| 3,716,101 | 2/1973 | McGowen, Jr. et al. | 166/65 |
| 3,739,845 | 6/1973 | Berry et al. | 166/65 R |

OTHER PUBLICATIONS

"Shape-Memory Alloys", by L. McDonald Schetky, Scientific American, vol. 281, pp. 74–82, Nov. 1979.

*Primary Examiner*—James A. Leppink
*Assistant Examiner*—Hoang C. Dang
*Attorney, Agent, or Firm*—Jerry Cohen; M. Lawrence Oliverio; William E. Noonan

[57] ABSTRACT

Subsurface safety valve assembly (16) for oil wells comprising a valve element (57) and a temperature responsive operator comprising multiple coil springs (69, 70), made of shape memory material, operable in opposing directions for opening and closing the valve element and a ratchet locking mechanism comprising wickers (79) for locking the valve in its open position after removal of the heating which causes shape memory effect movement to such position.

18 Claims, 13 Drawing Figures

SUBSURFACE WELL SAFETY VALVE AND CONTROL SYSTEM

BACKGROUND OF THE INVENTION

The present invention is an oil well device used to control the flow of fluid within a well. More particularly, the present invention is a subsurface safety valve which opens and closes a tubing string to control the flow of oil or gas produced from the well. Properly installed, the apparatus is designed to shut in the well automatically in the event of abnormal high or low pressure fluctuations, explosion or malfunction of surface equipment, fire or other dangerous situations such as a sudden release of underground pressure of subsurface formation.

The tubing subsurface safety valve of the present invention contains an improved means for operating the valve member which is designed to permit a quick response to speed valve closing in the event of an accident. The valve actuator of this invention comprises a temperature responsive helical coil spring which is constructed of a material having a temperature actuated shape memory. The valve operation can be achieved by expanding the helical coil actuator upon application of electrical heat which is supplied from a downhole trasformer.

Oil and gas wells must be protected against certain potential hazards in the event of damage or failure of the surface equipment. For example, a sudden release of underground pressure may cause the well to go wild and out of control, resulting in an oil spill or possibly a fire. To prevent uncontrolled flow of fluids from the well caused by such an accident, it is common practice to install a downhole safety valve in the tubing through which the fluids are produced. Even under normal operating conditions it is often desirable to employ such a valve to interrupt flow at subsurface depths.

Many subsurface safety valves are surface controlled, utilizing a hydraulic control system. Fluid is pressurized or depressurized and pumped into the hydraulic control line to open and close the valve. Hydraulic pressure is maintained in the control line to hold the safety valve open, and in the event of accident, the pressure in the control line is released and the safety valve automatically closes. Although these hydraulically controlled safety valves are in widespread daily use, they are subject to certain disadvantages and shortcomings.

Among the serious shortcomings of certain of these hydraulically controlled valves is the fact that the apparatus has to be equipped with a bias spring, or other counterforce means to close the valve operating mechanism.

These bias means work during closing operation in opposition to the various control fluid forces which would resist and delay the closure of the valve. (For this reason, it has been found impractical to utilize such valves at a great depth in a well as a long delay between initiation of valve closure and complete closure may occur).

For a surface controlled subsurface safety valve having a single hydraulic control line, as disclosed in U.S. Pat. Nos. 3,375,874; 3,703,193; 4,086,935; 4,193,450 and 4,214,606; and U.K. Pat. No. 1,565,625, three control fluid forces resist valve closure. First, a hydrostatic pressure force, proportional to valve depth, is created due to the presence of control fluid within the control line. Second, a fluid frictional force is created due to the required displacement of a relatively large volume of control fluid from the safety valve into the small diameter control line during valve closure. Third, the inertia of the control fluid, which was initially at rest, and which must be displaced back into the control line also resists the valve closure.

Utilizing dual hydraulic control lines, as disclosed in U.S. Pat. No. 3,696,868 and as illustrated in the composite catalog No. 805 of safety systems by Production Equipment Division, Hydril Company, permits the first, hydrostatic pressure force to be counterbalanced and, in effect, nulified. However, valve closure is still resisted by fluid frictional forces and the inertia of the mass of control fluid at rest. Additionally, there are extra equipment costs and handling problems whenever a well installation incorporates dual control lines for a single subsurface safety valve.

In hydraulically controlled subsurface safety valves, means for moving the valve includes a pressure chamber. The pressure in the pressure chamber is normally enclosed by sealing elements as shown in U.S. Pat. Nos. 4,086,935 and 4,214,606. These seals are essentially used to isolate the pressure chamber from communicating with the tubing bore pressure zone. Thus, in the event of seal failure in the area of the control pressure chamber, fluid of production tubing may enter the control pressure chamber causing the valve to fail in the open position. If this occurs, the tubing string must be pulled out and the sealing elements must be replaced.

A further disadvantage of the hydraulically controlled subsurface safety valves is that the hydraulic control line leading to the subsurface valve is susceptible to be damaged, or corroded, or otherwise leaks to permit reduction of the hydraulic control pressure, the safety valve will close in accordance with its "failsafe design" and the well will be shut in. To restore production, the tubing string must be pulled and the hydraulic control line replaced.

Another disadvantage of the use of hydraulically controlled subsurface safety valves is that extremely high hydraulic control pressures are sometimes required. This means that hydraulic control lines at the surface must carry high hydraulic pressure. These high hydraulic control pressures constitute a potential hazard to personnel working on the platform and/or around the wellhead.

There are other examples of subsurface safety valves in the prior art which are controlled by means other than hydraulic pressure. These have involved the application of an electromagnetic operating mechanism controllable from the surface by electrical lead wires extending along the tubing annulus to the sealed solenoid coil at the downhole safety valve. By the transmission of electric current from the surface the valve is opened and held open. Interruption of the current supply results in automatic closure of the valve. Examples of this subsurface safety valve are shown in U.S. Pat. Nos. 4,161,215 and 4,191,248. Due to valve construction and operating characteristics there are numerous limitations confronting the designer that are difficult to resolve when using solenoids to operate a valve. These may result in a delayed response to valve closure during an accident. The use of solenoid operated valves has never been fully successful for various reasons and their use has been found to be impractical.

Therefore, it is an object of this invention to provide an improved subsurface well safety valve which overcomes the aforesaid problems.

It is a further object of this invention to provide a subsurface well safety valve which exhibits improved valve performance and operates without delayed valve closure even at great depths.

It is a further object of this invention to provide a subsurface well safety valve which elminates leakage of control system fluid and thus reduces valve malfunction.

It is a further object of this invention to provide an improved system for controlling operation of the aforesaid valve which offers enhanced safety for nearby personnel and may be operated from surface and subsurface locations of controllers.

SUMMARY OF THE INVENTION

The present invention results from a realization that the performance of subsurface well safety valves may be made more rapid and dependable by utilizing a temperature sensitive shape memory alloy actuator for opening and closing the valve.

A shape memory alloy changes shape when it passes from a low temperature phase to a higher temperature phase. Such alloys are well known, and they, and the shape memory effect, are discussed in, e.g. "Shape Memory Alloys", Scientific American, v.281, pp. 74 to 82 (November 1979). The principle of shape memory alloys is also discussed in detail in our prior application Ser. No. 438,365, at page 3, line 16 to page 5, line 17, filed Oct. 29, 1982, and Ser. No. 464,787, at page 10, line 12 to page 11, line 28, filed Feb. 9, 1983.

The invention features a subsurface well safety valve apparatus including means defining an elongated substantially tubular housing adapted at each end for connecting to and communicating with sections of well tubing. Valve means are mounted within the housing and therein alternatable between an open condition for enabling fluid conduction through the housing bore and a closed condition for blocking fluid construction. Means for opening and closing the valve mean include first actuator means having a shape memory alloy material responsive to the temperature thereof rising to or above a predetermined level, corresponding to the transition temperature of the shape memory alloy, for opening the valve means and second actuation also having the preferred alloys of the present invention are those made from a ternary alloy of copper, zinc, aluminum or copper, aluminum, nickel, whose transformation temperatures are above the bottom hole temperature of an oil/gas well and below the coking temperature of the oil.

The apparatus may also comprise means for locking the shape memory alloy material and responding to the temperature thereof rising to or above a predetermined level, corresponding to the transition temperature of the alloy for closing the valve means.

In the present invention, either temperature responsive actuator, used in operating the valve member, is fabricated from a metal that exhibits shape memory behavior. The valve actuator of the present invention is constructed typically in the form of a helical spring which can be expanded upon application of heat. This can be accomplished by passing an electrical current such as generated by a transformer through the actuator to open or close the valve. This invention is therefore considered to be a simple and more effective subsurface valve and can be considered less expensive when compared to those of the prior art. This not only represents a major economy but, more importantly, it provides a valve that is faster than other valves and more responsive in an emergency.

The valve actuator in the form of helical coil spring is produced by initially winding it in its open coiled state, so that the pitch is appropriate to 2% shear strain when the spring is compressed to its close coiled state. Following winding, the spring passes through a number of heat treatment procedures, so as to give the spring its memory characteristics, after which, the spring will contract to its close coiled state at a temperature below the transformation and on heating above the transformation, it will expand axially to its open coiled state.

The apparatus may also include means for locking the valve means in an open condition when the temperature of the first actuator falls below the predetermined level. Means, responsive to transformation of the second actuator means upon being heated to or above the pedetermined level, may be provided for releasing the locking means. Bearing means may be provided for urging the valve means to maintain a closed condition when the temperature of the second actuator means drop below its predetermined level.

The valve means may include a ball valve element, a valve seat, and means responsive to transformation of the first and second actuator means upon being heated to or above their respective predetermined temperature levels for rotating the ball valve element within the seat respectively between open and closed conditions.

The housing may include means defining one or more annular chambers. The helical springs of the first and second actuator means are typically arranged in such chambers. The first actuator means may include a pair of springs, or more, arranged either concentually or end to end within one or more chambers. Means may be provided for sealing one or more of such chambers against fluid being conducted through the bore of the tubular housing.

Means, such as a transformer and suitable electrical connectors may be provided for heating the first and second actuator means.

The present invention also provides a better method of controlling valve function. It may be controlled at either surface or subsurface locations through the sensing controls, which are installed at the surface and at the subsurface, respectively. This has been found to be impractical for subsurface valves which are hydraulically controlled.

The sensor means sense changes in surface and subsurface well conditions and provide a signal in response thereto. Control means, responsive to the sensor signals, may be provided for operating the means for heating to thereby control heating of the first and second actuator means.

In this invention, by employing a temperature-responsive valve actuator, improved valve performance is obtained without delayed valve closure even though the valve is installed at a depth greater than that at which existing subsurface valves can operate. This invention also ensures that the tendency of valve malfunction as frequently encountered in those of the prior art, e.g. due to leakage of fluids on the control system, is minimized. The present invention also provides an improved safety system for personnel working near the wellhead and/or the surface equipment, since the control system of the present invention does not have high working pressures.

The invention of the instant application will be more fully understood from the following description of the embodiment of the invention with reference to the drawings which:

BRIEF DESCRIPTION OF THE DRAWING

FIG. 2B should be viewed as immediately beneath FIG. 2A.

In FIG. 5A, two helical compression springs are used in a concentric arrangement called a spring nest. In FIG. 5B the two helical compression springs are positioned in stacks.

DETAILED DESCRIPTION OF PREFERRED EMBODIMENTS

Figure 1:
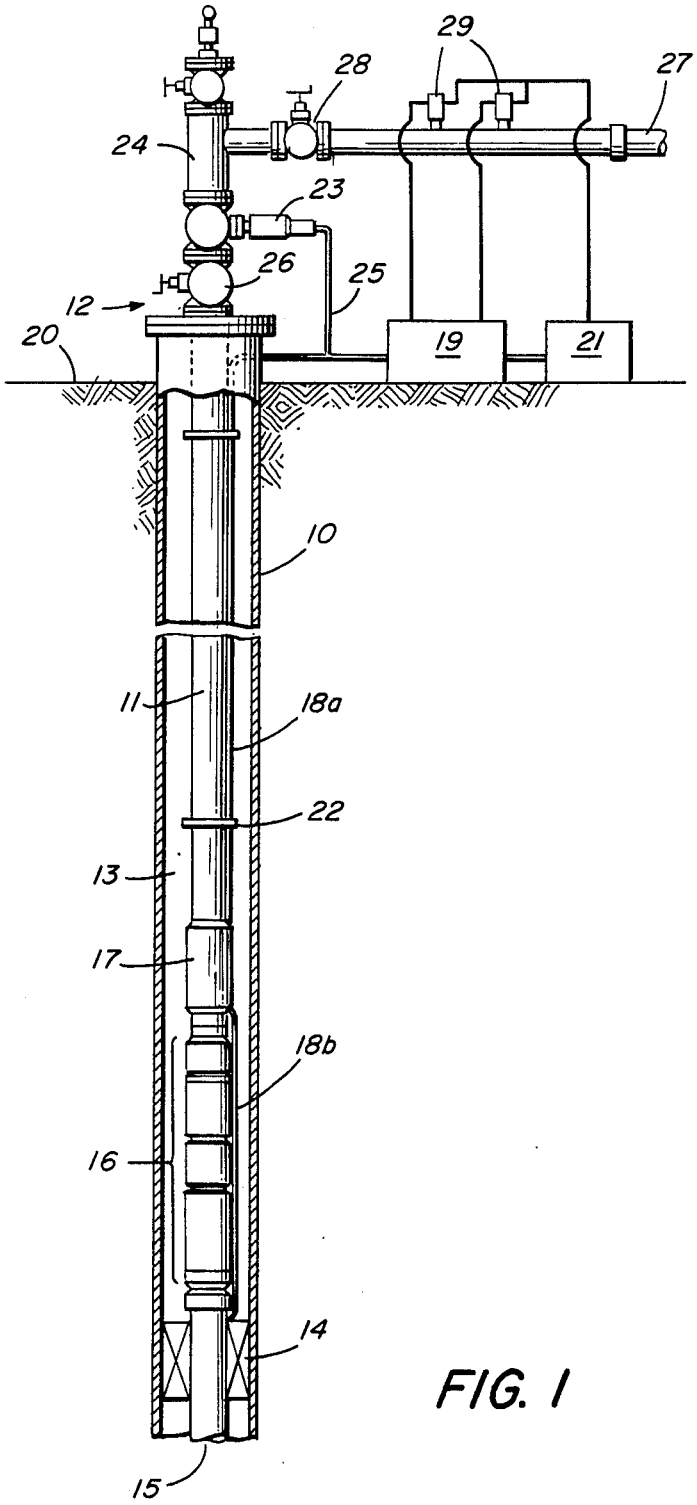
FIG. 1 is a schematic representation showing the relationship of the subsurface safety valve of the invention with a production tubing string and associated control equipment comprising a Christmas tree equipped with main valves and surface safety valve, a downhole transformer, surface and subsurface control lines, surface console and a power source.

Referring to the drawings and particularly to FIG. 1, a schematic view of the well safety system of the present invention is shown. Casing 10 is disposed within the well bore and extends from the surface to a subsurface formation (not shown). Tubing string 11 is disposed within casing string 10 and partially supported by wellhead 12. Annulus 13 is formed between tubing 11 and casing 10. Packer 14 forms a fluid tight seal between tubing 11 and casing 10 within annulus 13. Packer 14 directs fluid flow through bore 15 of tubing 11.

A subsurface safety valve assembly 16 of the present invention is made up as part of tubing 11, installed above packer 14. The actuator (described with FIGS. 2A and 2B; 3A and 3B) of the subsurface safety valve 16 is energized by an electrical current supplied from a transformer 17 which is installed above the safety valve system 16 incorporating with tubing 11. At transformer 17, two cable lines are connected; one (indicated at 18*a*) extends between the subsurface safety valve 16 and a control console 19 at the surface 20, while the other cable 18*b* is connected to a subsurface sensing device located below apparatus 16. As shown in FIG. 1, a series of clamps 22 hold cable 18*a* against tubing string 11. Control console 19 is connected to an electrical power source 21 supplying power via cable 18*a* to transformer 17 downhole.

For greater safety system reliability, a surface safety valve 23 is frequently installed as a part of Christmas tree 24 and connected to the power source 21 via the control console 19 and cable 25. This surface safety valve 23 may also be constructed in a manner similar to the subsurface safety valve of the present invention using a helical coil actuator made of a shape memory material. In addition to this surface safety valve 23, a valve 26 is positioned as is positioned as part of the wellhead above casing 10, and may be used to shut-in the well when desired.

The fluids which are produced from the well are directed through a flowline 27 to a desired location for storage or processing. A valve 28 is positioned in the flowline 27, for selectively producing or closing in the well. Also in flowline 27, several sensing devices shown at 29 are designed to accurately monitor the system situations. When monitored conditions are beyond a preset limit of the sensing device (in the event of accident) the sensing device will establish a closed circuit between power source 21 and transformer 17 through control console 19, automatically supplying electrical heat to the actuator of the subsurface safety valve in a valve closing position. (In many cases, control console 19 may also have a manually operated means). At the same time, the electrical current also flows into the actuator of surface safety valve 23 and closes the valve.

In addition, to the controlled sensing devices at surface flowline 27, some sensing device is also installed at a subsurface location below the subsurface valve apparatus (not shown). This sensing device is designed to monitor any abnormal conditions or a sudden release of undergrounding pressure.

Referring now to FIGS. 2A and 2B, and 3A and 3B, the tubing subsurface safety valve assembly 16 of the invention will be described in detail. As shown in the drawings, the valve assembly consists of three main parts: a housing, valve means and means for opening and closing the valve means.

The housing 50 is provided by five separate components which are connected by means of a coupling 51, sleeve connectors 52 and 53, and threads at 54. Housing 50 has a bore 55 therethrough. Means are provided for connecting the valve assembly within the tubing string 11. The connecting means may be threads 56 at either end of the housing 50 which attach to complementary threads of the tubing string.

A valve including a valve member and a valve seat is disposed in bore 55 of housing 50. The valve member is adapted for movement between bore openings and bore closing positions. Any desired type of valve, such as a rotating ball or flapper may be used.

In FIGS. 2A, 2B and 3A, 3B a rotating ball valve element 57 is illustrated. Ball valve 57 has a passage 58 therethrough which has the same diameter as the bore 55. Ball valve 57 is rotatable between the position shown in FIGS. 2A, 2B where the passage 58 is aligned with bore 55 and fluid can flow through the valve, and the position shown in FIGS. 3A, B where passage 58 is not aligned with bore 55 and an effective seal to upward fluid flow through the valve is provided.

An upper seat member 59 seals with ball valve 57 and the housing 50 to inhibit upward fluid flow through the safety valve. To seal ball valve 57, the upper seat member 59 has a sealing face 60. The valve assembly also includes a lower valve seat member 61. This seat member 61 also has a sealing face 62 which engages ball valve 57. The rotating ball valve 57 is therefore confined between the upper seat member 59 and the lower seat member 61 in such a manner that the sealing faces 60 and 62 remain in contact with the outer surface of ball valve 57. This confinement wipes ball valve 57 clean whenever it is rotated and prevents a build-up of material around the seats which may inhibit the sealing.

The downward movement of ball valve 57 is stopped with the ball valve in a valve opening position by the engaging of the edge 63 of the lower seat member 61 with a shoulder 64 of the housing 50. Its upward movement is stopped with the ball valve in a valve closing position by the engagement of position of the ball valve 57 with another shoulder at 65.

Means for remotely operating (i.e. opening and closing) ball valve 57 include a valve member operator, temperature-responsive shape memory actuators and biasing means springs.

Figure 2A:
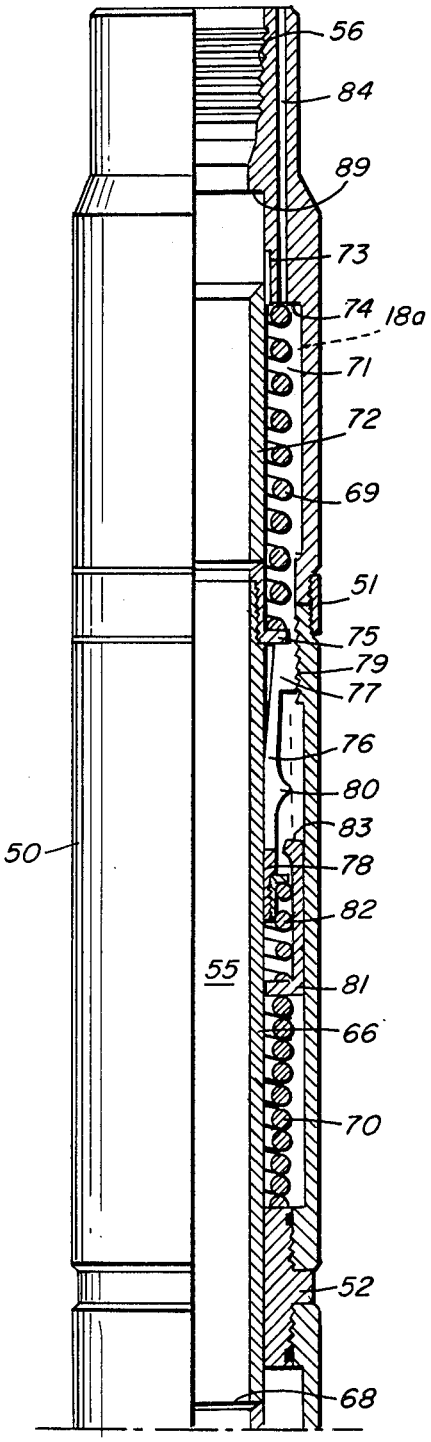
FIGS. 2A and 2B together constitute a longitudinally sectional view of a subsurface well control apparatus of the invention illustrating the safety valve in the opened position.
Figure 2B:
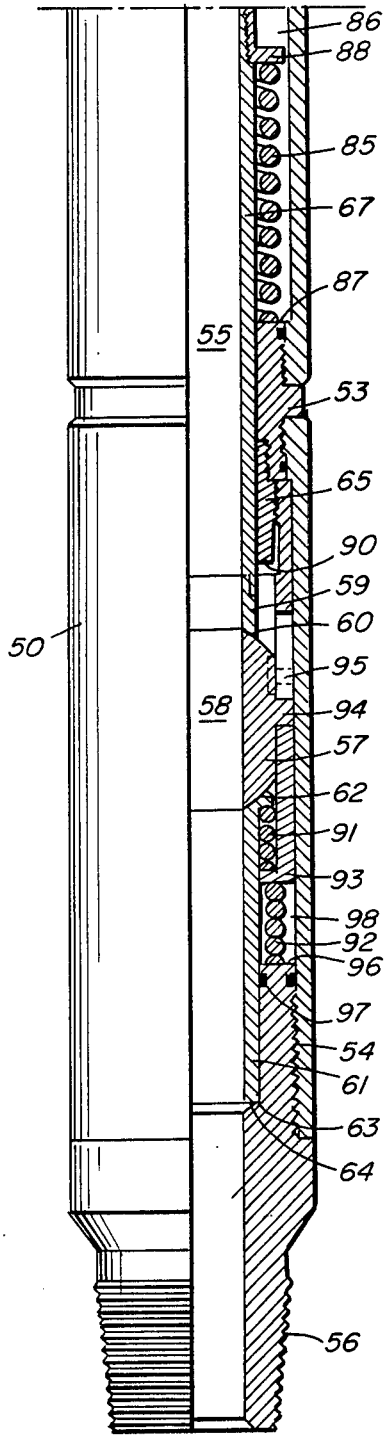
Figure 3A:
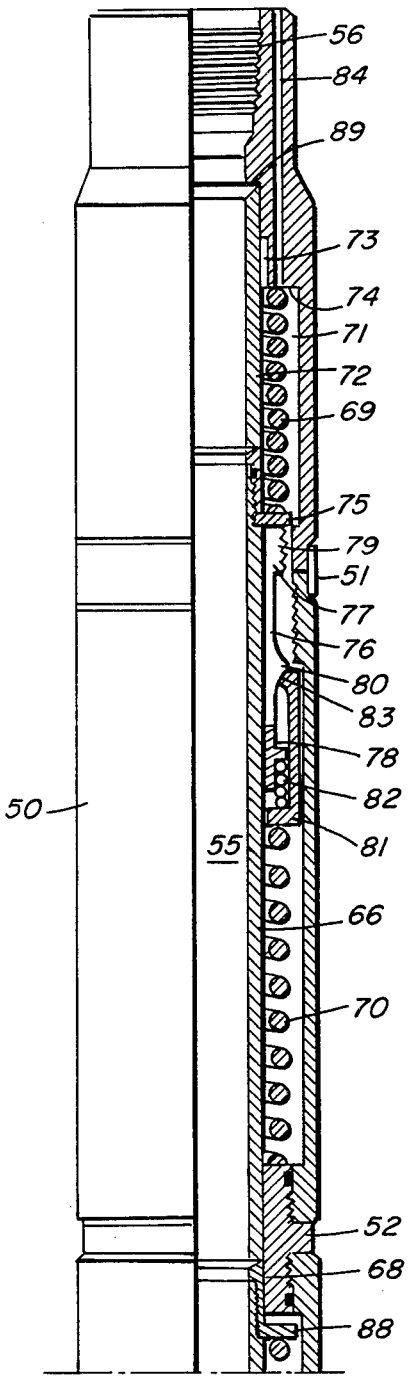
FIGS. 3A and 3B also constitute a longitudinally sectional view of the subsurface well control apparatus, similar to the positions as shown in FIGS. 2A and 2B, respectively, and illustrating the valve member in the closed position.
Figure 3B:
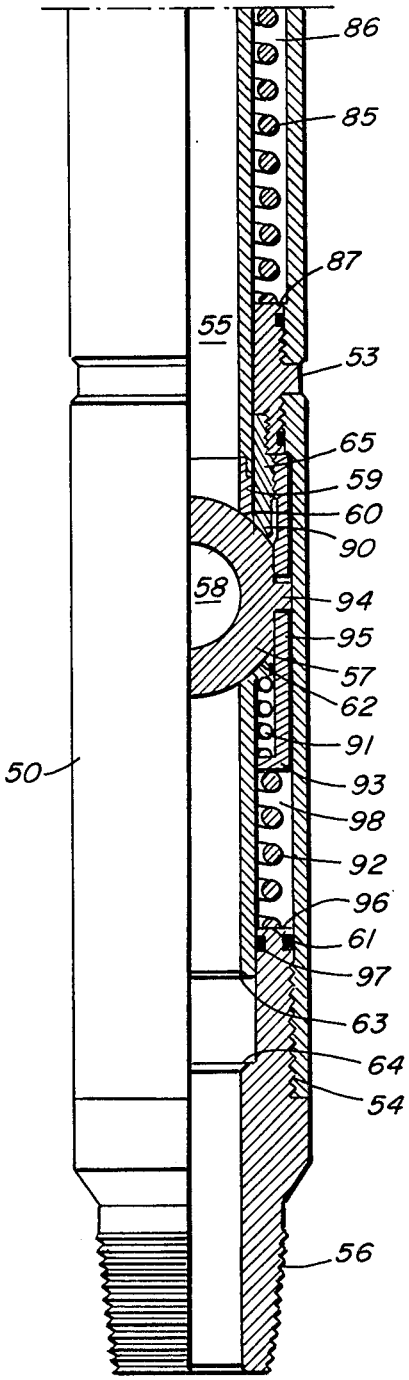

As illustrated in FIGS. 2A, 2B and 3A, 3B, the valve member operator may be a two-piece valve member operator. It includes an upper sleeve 66 and a lower sleeve 67. The bottom edge of the upper sleeve 66 connects to the top edge of the lower sleeve 67 at 68. The valve member operator is movable to a first position, as shown in FIGS. 2A, 2B wherein the ball valve is in a valve opening position and is also movable to a second position, as shown in FIGS. 3A, 3B wherein ball valve 57 is in a valve closing position.

Two actuator means 69, 70 in the form of a helical coil spring are provided to control the movement of the sleeves 66, 67. (These two actuators are called shape memory actuators). The upper shape memory actuator 69 is provided to move sleeves 66, 67 to their first position in a bore opening position (see FIGS. 2A, 2B), while the lower shape memory actuator 70 is provided, to operate the sleeves 66, 67, to their second position in a bore closing position (see FIGS. 3A, 3B). The upper actuator 69 is disposed in the annular chamber 71 between the cylindrical sleeve 72 and the housing 50. (To prevent fluid flow communicated from the bore 55 into annular chamber 71, seals are provided at 73 of the housing 50). The actuator 69 is engaged by a shoulder 74 of the housing 50, and it engages a shoulder 75 at the lowermost end of the cylindrical sleeve 72.

Shoulder 75 interfaces with flexible finger member 76 through an annular head 77, so that it can transfer the downward load applied from the expanding shape memory actuator 69. Finger 76 is connected by threads 78 to upper sleeve 66 of the valve member operator. The flexible finger member 76 normally flexes outwardly, and has a series of circumferential wickers 79 at its head 77. The flexible finger member 76 is also provided with a profile 80 which is engaged by a control cage 81 upon the upward movement of lower actuator 70, in a valve closing position, FIGS. 3A, B. The upward movement of the actuator 70 during closing operation applies an upward force to control cage 81, which then transfers the force first, to a helical compression spring 82 and subsequently to finger 76 via the guide nose 83 of the control cage 81, FIG. 3A.

Means for supplying electrical heat to the actuators 69 and 70 is provided with downhole transformer 17 installed above the tubing safety valve assembly, as illustrated in FIG. 1. Cabling 18*a* for passing electrical current from the transformer's secondary winding to the actuators can be passed through a passageway 84 through housing 50 opening into chamber 71. At the end of such cabling are resistance or induction heating elements. Alternatively, the springs can be self heated by connection of the cabling thereto (and appropriate insulation provision to avoid shorting out of such self heating circuit.)

First biasing means 85 assists in moving the valve member operator to its second closed position upon the activation of lower actuator 70. The first biasing means 85 exerts a force against the sleeves 66, 67 to assist the upward movement upon an application of electrical heat on actuator 70. This first biasing means is provided by a main helical compression spring 85 disposed in the annular chamber 86 between lower sleeve 67 of the valve member operator and housing 50. This spring 85 is engaged by a shoulder 87 of the housing 50, and it engages a shoulder 88 of lower sleeve 67.

Stop means are provided to limit the upper movement of valve member operators 66 and 67 once they have reached the second position under the action of actuator 70 and the first biasing means 85. These stop means comprise upper edge 89 of housing 50 and lower edge 90 of the shoulder 65.

Additional biasing means include means 91, 92 biasing against ball valve 57 during the operation to a bore opening position. This ball valve opening movement is resisted by means of a lower seat member 61 which is urged upwardly against the exterior of the ball valve 57 by means of a compression spring 91 carried externally around the uppermost end of lower seat 61. It should be noted that the compressive force defined through spring 91 simply urges lower seat 61 against the lowermost exterior of ball valve 57. However, the compressive force of spring 91 is not sufficient to manipulate ball valve 57 from open to closed position. Such manipulation of ball valve 57 is afforded by means of a compression spring 92 which also is carried exteriorly around lower seat 61. The uppermost end of spring 92 being urged against the lowermost end of the cage arms 93 which surround the exterior of lower seat 61. Spring 92 pushes cage arms 93 up against the ball centralizing pin 94 such that there is very low frictional contact between sealing face 62 of lower seat 61 and ball valve 57 from open position to closed position.

Figure 4A:
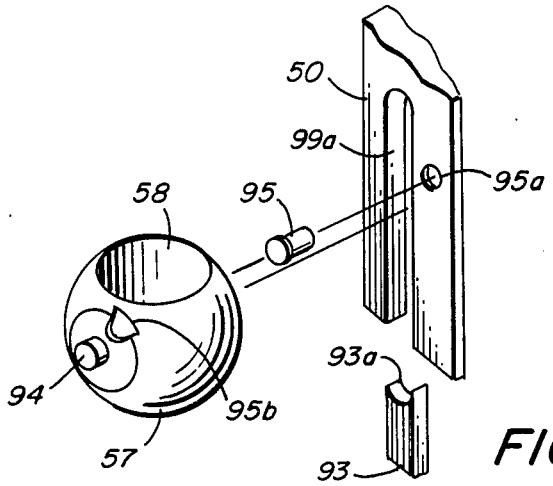
FIG. 4A is an exploded view of the ball valve and manipulation components with the ball valve in open position, as shown in FIGS. 2A and 2B.
Figure 4B:
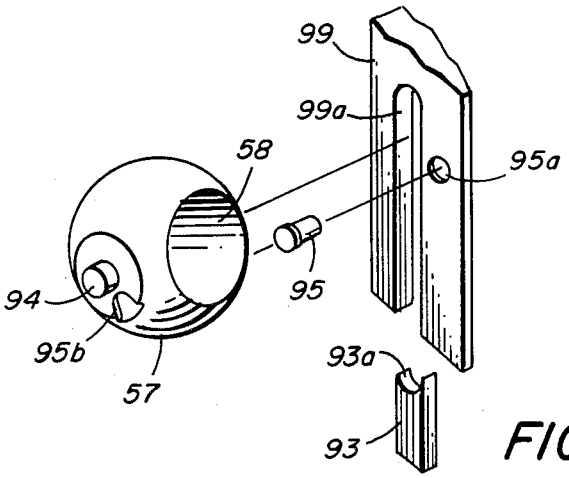
FIG. 4B is a view similar to that of FIG. 4A illustrating the relationship of the various components relating to the ball valve, the ball valve being shifted to the closed position, as shown in FIGS. 3A and 3B.

Referring particularly to FIGS. 4A and 4B, the housing 50 provides elongated travelways 99*a* defined 180 degrees apart for receipt and selective movement of a cage arm 93. (The opposite side of housing 50 and its travelway 99*a* are omitted for clarity). The cage arm 93 provides a profiled seat 93*a* at its uppermost end which used to receive a centralizing pin 94 on the ball valve 57. There are two control pins 95, only one of which is shown, spaced 180 degrees apart within the housing 50. These pins 95 are received within a control groove 95*b* profiled on the exterior of the ball element 57 and nested within a receptacle 95*a* in the housing 50. The pin 94 centralizes ball movement during reciprocation and also receives load from the cage arms 93, while the control pin 95, in combination with the control groove 95*b*, reciprocates the ball valve 57 from opened to the closed position or vice versa.

The lowermost end of spring 92 (FIGS. 2A, 2B, and 3A, 3B) rests upon a shoulder 96 of housing 50. An elastomeric ring is provided at 97 of housing 50 to prevent fluid communication between the annular chamber 98 and the bore 55.

In operation, (viewing FIGS. 1–4 simultaneously) the disclosed apparatus is described as follows:

In opening operation of the tubing safety valve 16, electrical heat is transmitted through a downhole transformer 17 to upper actuator 69. With increase of its temperature, actuator 69 expands and moves downwardly to exert a high force. The force is transferred via shoulder 75 to finger member 76. When the force of the actuator 69 overcomes the force exerted upon the valve member by the upward force, the actuator 69 moves the valve member operator to a first position, FIGS. 2A, 2B thereby moving ball valve 57 to its bore opening position. As actuator 69 moves downwardly, finger member 76 is also moving down and consequently head 77 of finger member 76 rests on the wickers of housing 50. Under this condition, valve member operator 66, 67 are urged to hold ball valve 57 in the opened position even though the electrical heat is switched off, and actuator 69 has returned to its initial close coiled shape. Construction of the wickers 79 of finger member 76 and the wickers of housing 50 permit collect head 77 to ratchet downwardly, but prevent it from ratcheting upwardly. This downward travel of collect head 77 on the wickers of the housing 50 provides a locked open valve position.

To close the safety valve automatically in response to emergencies, the lower actuator 70 is energized by passing an electrical current in it. This causes the actuator 70 to expand and move in an upward direction. The force exerted during its movement to move the valve member operator to a valve closing position is also assisted by the bias spring 85. Spring 70 bears against control cage 81. As such upward force is applied through control cage 81, the spring 82 is compressed into its close coiled shape so that guide nose 83 of control cage 81 becomes engaged with profile 80 of finger member 76. This engagement causes finger member 76 to flex inwardly, thereby releasing collect head 77 from the wickers of housing 50. Under this condition, finger member 76 together with the sleeve 66 of the valve member operator commences its upward movement into a second position. With the valve member operator in this second position, the ball valve 57 is moved to a position closing bore 55. The biasing means of springs 91 and 92 supplements the closing force exerted on the ball valve 57 by urging it upwardly to rotate ball valve 57 to a bore closing position, FIGS. 3A, 3B. Once ball valve 57 in its closed position, the electrical current supplied to actuator 70 is automatically switched off, and actuator 70 will resume its original contracted shape while it cools down. (The heating time required may be about 3 seconds in most cases). Now, spring 85 holds the valve member operator in its second position. As actuator 70 returns to its close coiled shape, control spring 82 is able to urge control cage 81 downwardly, so that guide nose 83 of control cage 91 become disengaged from profile 80 of finger member 76. Under such condition, finger member 76 is permitted to flex outwardly so that collect head 77 rests on the unwickered surface of housing 50.

Figure 5A:
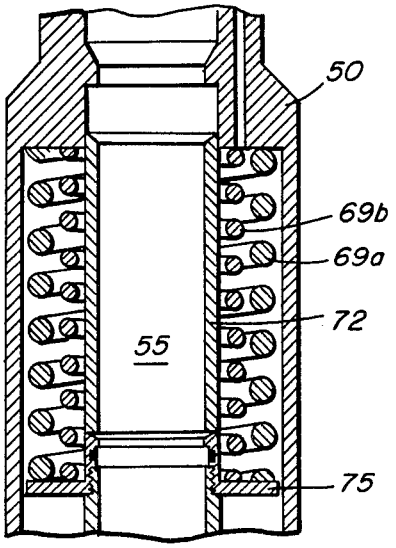
FIGS. 5A and 5B are cross-sectional views of compression spring arrangements for enabling the actuator to obtain a greater load-carrying capacity which provides the total load as a summation of the two spring loads.
Figure 5B:
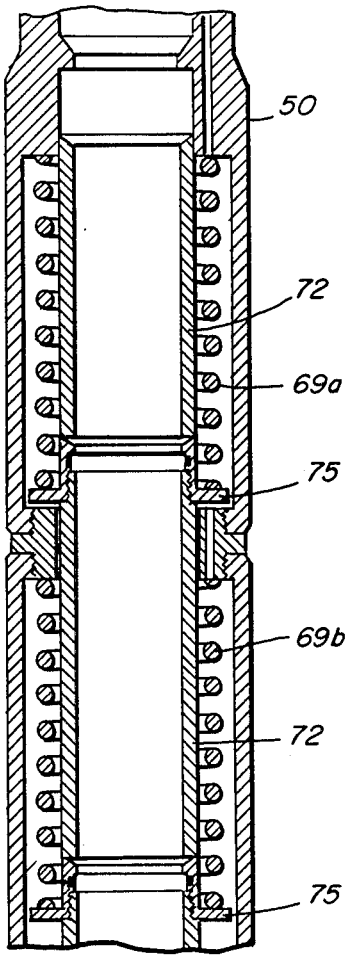

In operation of ball valve 57 into its opening position the movement of upper actuator 69 in downward direction is resisted by upward forces due to differential upward fluid pressure across ball valve 57 and the biasing springs. To overcome these upward forces, the upper actuator must be able to exert high forces such that it is greater than the upward forces. In particular cases, a single spring may be sufficient to move ball valve 57 into a valve opening position. In order to obtain a greater load carrying capacity, actuator 69 may be made of two compression springs 69*a, b* which are positioned in a concentric arrangement as illustrated in FIG. 5A or are arranged in stacks as shown in FIG. 5B. In the embodiment of FIG. 5B each spring surrounds a cylindrical sleeve 72 and rests on a shoulder 75. The respective sleeve are threadably connected. Accordingly, the two springs are equally stressed at all load positions down to the solid height of the outside spring. The total load exerted by the two springs in the arrangements shown in FIGS. 5A, 5B are equal to a summation of loads of each spring. Construction as in FIG. 5A is used where a sufficient tubing diameter is available. On the other hand, construction as in FIG. 5B is used where the tubing diameter of the valve assembly is limited so that it provides reduced coil diameter. However, the design at FIG. 5B requires an additional tubing length.

Other means in obtaining a high downward force to move the ball valve 57 to a bore opening position is by pumping fluid into the tubing in a first, downward, direction. The fluid acts against ball valve 57 urging to equalize the differential pressure across ball valve 57.

Once the equilization is reached, actuator 69 is then actuated to force the valve member operator and moves it against the force of the urging means to a bore opening position. Since springs 91 and 92 do not have to assist the main spring 85 during closing operation, and since their function is simply to bias the ball valve 57 to a closed position, they can be such much weaker than main spring 85, so that force being exerted by the actuator 69 downwardly will overcome the force exerted on ball valve 57 by springs 91 and 92 and move ball valve 57 to its bore opening position.

Figure 6A:
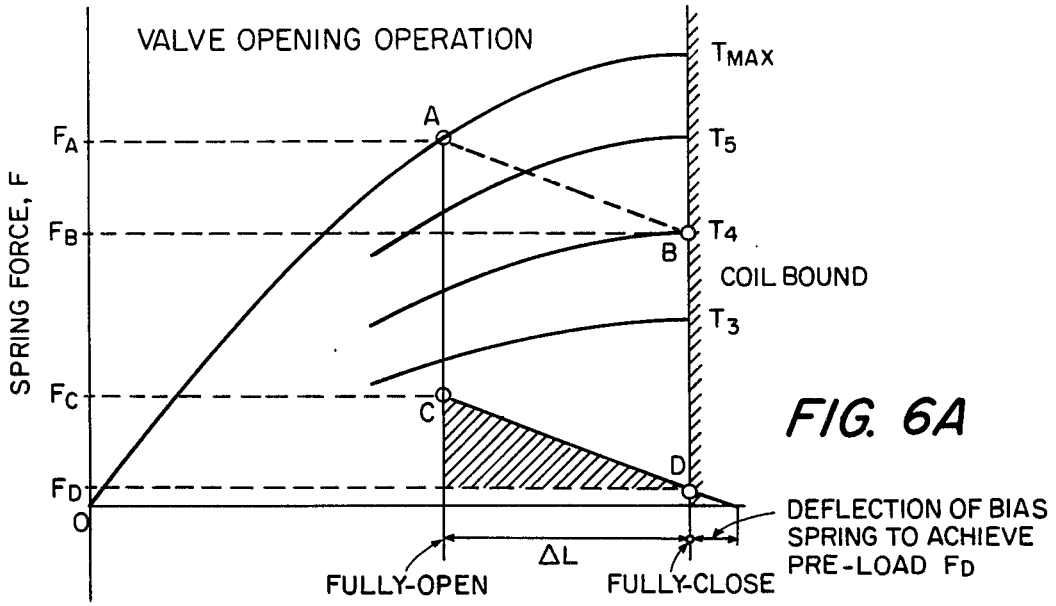
FIGS. 6A through 6D represent the characteristics of the spring actuators incorporating with the associated resistant loads upon the movement of the valve member operator.
Figure 6B:
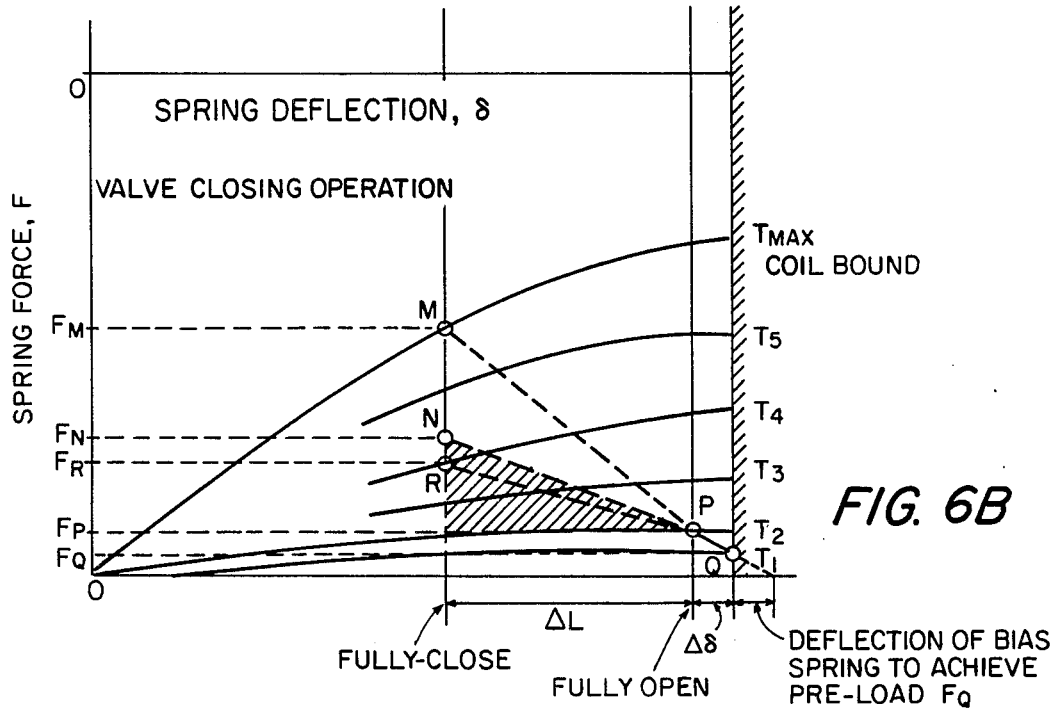

Referring now to FIGS. 6A, 6B the valve operating mechanism and the related helical spring characteristics involved are discussed. As described previously, in the operation of the apparatus of the invention to either a bore opening or a bore closing position, the two shape memory actuators have to be heated (electrically) independently above the transformation temperature of the actuator material. Expansion of the actuator is almost instantaneous when the electrical energy is delivered from the transformer and the force exerted by the actuator is then applied to move the valve member operator. (The illustrated actuator charcteristic is represented by point A in FIG. 6A or point M in FIG. 6B corresponding to the properties of the high temperature of the alloy shown by a curved line at Tmax). When the electrical current is switched off the shape memory actuator will contact and resume its close-coiled form to its original position.

As illustrated in FIGS. 6A and 6B, the shape memory actuator and bias spring are required to move the valve member operator through a distance of $\Delta L$ for opening or closing the valve. The load/deflection/temperature plots for the valve opening and valve closing operation are sketched diagrammatically in FIGS. 6A and 6B, respectively, each showing a shape memory actuator overimposed with lines of constant stiffness of bias spring and/or constant upward force due to the pressure differential across the valve. Points of intersection of the lines with the shape memory actuator represent points of equilibrium between the working forces and the actuator.

From FIG. 6A of valve opening operation, the actuator would deflect by an amount of $\Delta L$ under the total load $F_A$, as the temperature increases to $T_{max}$. During this opening operation, two forces resist the actuator, the upward force ($F_B-F_D$) due to the pressure differential across the valve, and the upward biasing force due to main spring 85 (see FIG. 2B). There is clearly shown in FIG. 6A the movement of the valve member operator commencing at temperature $T_4$ with a force $F_B$ exerted by the actuator. This force $F_B$ is applied to overcome the working forces as given by:

$$F_B=(F_B-F_D)+F_D,$$

where $F_D$: the pre-load of the bias spring 85.

The equilibrium of the final position at which the valve member is fully opened is given by:

$$F_A=(F_B-F_D)+F_C$$

where $F_A$: the downward force exerted by the actuator at $T_{max}$ to achieve a travel distance of $\Delta L$.

$F_B=F_D$: the upward force due to the pressure differential across the valve, and $F_C$: the biasing force of main spring 85 to deflect into a fully opened valve position.

During the valve closing operation as shown in FIG. 6B, prior to the commencement of the valve member operator into a closing movement, first, the lower actuator must overcome the biasing load due to a control bias spring 82 (see FIG. 3A). The temperature change from $T_1$ to $T_2$ is required to push the spring 82 upwardly into a close-coiled shape with a deflection of $\Delta\delta$, represented by point P. From point P, the valve member operator starts to move into a closing position. The main spring 85 (see (FIG. 3B) supplements an upward movement to the actuator by releasing its force/energy, the energy of which was stored during the opening operation. This energy released is projected by the shaded area shown in FIG. 6B which is equal to the energy stored during the opening operation, as indicated also be the shaded area in FIG. 6A. For this reason, the actuator required for this closing operation is not necessarily a strong spring, and the heating temperature is also relatively low. (The heating temperature is in fact arbitrary to some extent as its value is lower than the peak operating temperature $T_{max}$). From FIG. 6B, the resulting force to operate the valve into a closing position is thus given by:

$$F_M+(F_N-F_P)-F_P \text{ for } T_{max}, \text{ or}$$

$$F_R+(F_N-F_P)-F_P \text{ for } T_4$$

while, ($F_N-F_P$) of FIG. 6B=$F_C-F_D$ of FIG. 6A, i.e. the biasing force of spring 85

$F_P$: the biasing force due to control spring 82 and, $F_M$ and $F_R$: the upward forces exerted by the actuator at $T_{max}$ and at $T_4$, respectively.

Figure 6C:
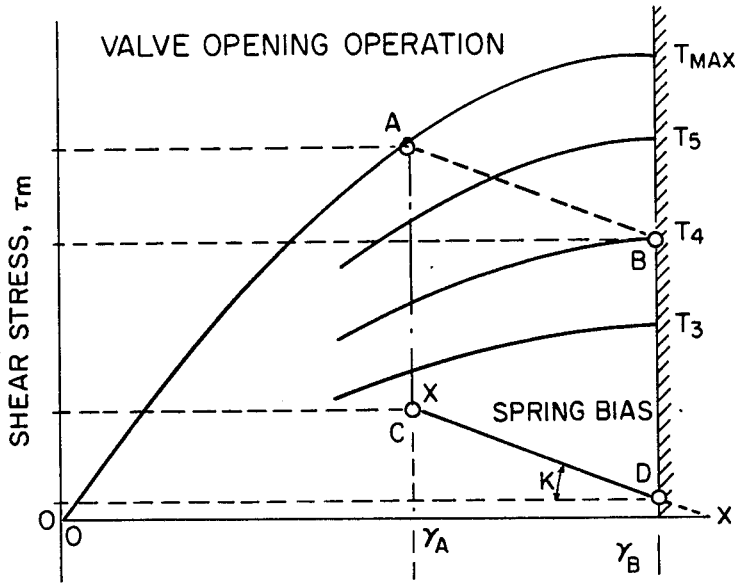
Figure 6D:
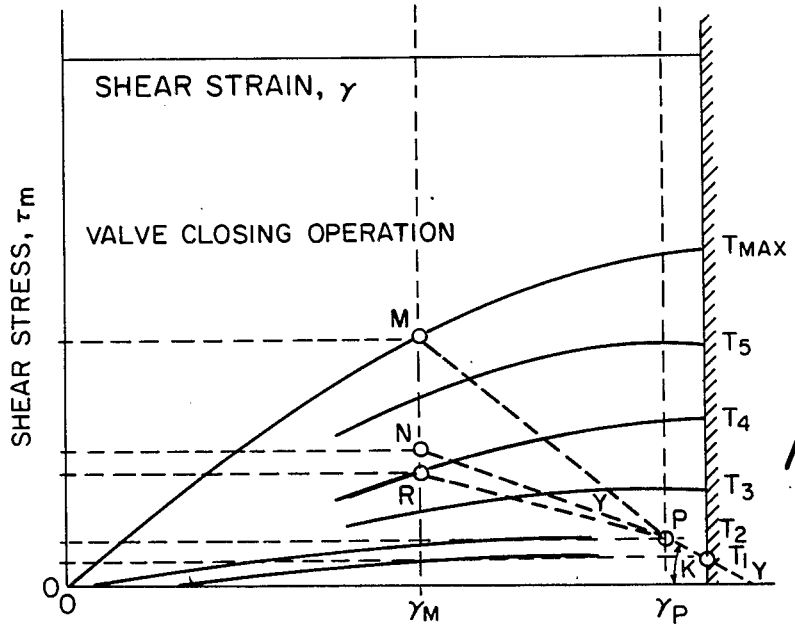

The actuator and bias spring dimensions can be determined from conditions shown in FIG. 6C and FIG. 6D of the stress-strain spectrum.

The actuator dimensions used to move the valve member operator to a bore opening operation can be determined from conditions at points A and B of the design chart, FIG. 6C thus:

At point A

Shear stress is given by:

$$\tau_m|_A=K(\gamma_A)\tau_o|_A$$

and since $$\tau_o|_A=\frac{8\cdot D}{\pi\cdot d^3}\cdot F_A,$$

shear stress at A becomes:

$$\tau_m|_A=K(\gamma_A)\cdot\frac{8\cdot D}{\pi\cdot d^3}\cdot F_A$$

where $F_A=(F_B-F_D)+F_C$

Shear strain is given by:

$$\gamma|_A=\frac{d}{\pi\cdot D^2\cdot n}\cdot\delta_A$$

where:

$\tau_m|A$: the actual shear stress at point A for a shape memory spring wire.

$\tau_o|_A$ the elastic shear stress at point A $K(\gamma_A)$: the correction factor which is a function of shear strain at point A. This factor can be obtained experimentally.

D: mean coil diameter d: wire diameter n: number of active coils of the spring $\delta$: spring deflection ($F_B-F_D$): the upward force due to the pressure differential across the valve $F_C$: the total biasing force $F_D$: the pre-load force of the bias spring At point B Shear stress is given by :

$$\tau_m|_B=K(\gamma_B)\cdot\frac{8\cdot D}{\pi\cdot d^3}\cdot F_B$$

where $F_B=(F_B-F_D)+F_D$ shear strain is given by:

$$\gamma|_B=\frac{d}{\pi\cdot D^2\cdot n}\,\delta_B$$

The strain change between points A and B:

$$\gamma_B-\gamma_A=\frac{d}{\pi\cdot D^2\cdot n}\cdot\Delta L$$

where $\Delta L$: the travel length of the valve member operator in a valve opening or closing position.

The stiffness of the bias spring k can be determined as follows:

$$k=\frac{\partial F}{\partial\delta}=\frac{\partial F}{\partial\gamma}\;\frac{\partial\gamma}{\partial\delta}$$

$$\text{Now, }\frac{\partial F}{\partial\gamma}=\frac{1}{8D/\pi d^3}\;\frac{\partial(8DF/\pi d^3)}{\partial\gamma}$$

$$\text{and }\frac{\partial\gamma}{\partial\delta}=\frac{d}{\pi D^2 n}$$

whence,

-continued $$k = \frac{d^4}{8D^3n} \frac{\partial \tau_m}{\partial \gamma}$$

The value of $$\frac{\partial \tau_m}{\partial \gamma}$$

is evaluated from FIG. 6C, i.e. the slope of line X—X.

Now, the actuator dimensions used to move the valve member operator to a bore closing operation can also be determined using the similar procedure as described above, from conditions at points M and P of the design chart, FIG. 6D, thus:

At point M:

Shear stress is given by:

$$\tau m|_M = K(\gamma_M) \cdot \frac{8 \cdot D}{\pi \cdot d^3} F_M$$

where $F_M$=the upward force exerted by the actuator at $T_{max}$ shear strain is given by:

$$\gamma|_M = \frac{d}{\pi \cdot D^2 \cdot n} \delta_M$$

At point P:

Shear stress is given by:

$$\tau_m|_p = K(\gamma_p) \frac{8 \cdot D}{\pi \cdot d^3} F_p$$

where $F_P$: the biasing force due the control bias spring (see description in the text).

The strain change between points M and P $$\gamma_p - \gamma_M = \frac{d}{\pi \cdot D^2 \cdot n} \cdot \Delta L$$

The stiffness of the bias spring k can be determined as follows:

$$k = \frac{d^4}{8 \cdot D^3 \cdot n} \frac{\partial \tau_m}{\partial \gamma}$$

The value of $$\frac{\partial \tau_m}{\partial \gamma}$$

is evaluated from FIG. 5*d*, i.e. the slope of Line Y—Y.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features presented, or possessed by, the apparatus and techniques herein disclosed and limited soley by the spirit and scope of the appended claims.

What is claimed is:

1. A subsurface well safety valve apparatus comprising:

means defining an elongate substantially tubular housing adapted at each end for connecting to and communicating with sections of well tubing, valve means mounted within said housing and therein alternatable between an open condition for enabling fluid conduction through the bore of said tubular housing and a closed condition for blocking fluid conduction therethrough, and means mounted within said housing for selectively opening and closing said valve means including opposing first and second actuator means, each including a shape memory alloy material which undergoes complementary shape transformations when respectively heated to or above or cooled below a predetermined temperature corresponding to the transition temperature of the shape memory alloy and each having a pair of ends, one end engaging said housing, said means for opening and closing further including means interconnecting the respective other ends of said opposing first and second actuator means and said valve means and being shiftable between a first valve open position and a second valve closed position, and means for heating said first actuator means to or above its predetermined temperature while said second actuator means is cooled below its predetermined temperature for transforming said respective actuators to shift said interconnecting means to its first position to open said valve means and means for heating said second actuator means to or above its predetermined temperature while said first actuator means is cooled to below its predetermined temperature for transforming said respective actuators to shift said interconnecting means to its second position to close said valve means.

2. Apparatus in accordance with claim 1 further including means for locking said valve means in an open condition when the temperature of said first actuator means falls below said predetermined level.

3. Apparatus in accordance with claim 2 further including means responsive to transformation of said second actuator means upon being heated to or above said predetermined level, for releasing said locking means.

4. Apparatus in accordance with claim 1 further including biasing means for urging said valve means to maintain a closed condition when the temperature of said first actuator means drops below said predetermined level.

5. Apparatus in accordance with claim 1 wherein said valve means inludes a ball valve element and a valve seat.

6. Apparatus in accordance with claim 1 wherein said first actuator means include spring means.

7. Apparatus in accordance with claim 1 wherein said second actuator means includes spring means.

8. Apparatus in accordance with claim 1 wherein said housing includes means defining one or more annular chambers.

9. Apparatus in accordance with claim 8 wherein said first actuator means includes a helical spring disposed in a said chamber.

10. Apparatus in accordance with claim 8 wherein said first actuator means include a plurality of helical springs arranged concentrically within a said chamber.

11. Apparatus in accordance with claim 8 wherein said first actuator means include a plurality of helical springs arranged end to end within one or more chambers.

12. Apparatus in accordance with claim 8 wherein said second actuator means include a helical spring disposed in a said chamber.

13. Apparatus in accordance with claim 8 further including means for sealing one or more of said chambers against fluid being conducted through the tubular housing bore.

14. Apparatus in accordance with claim 1 wherein said means for selectively heating include a transformer and means for electrically connecting said transformer respectively with said first and second actuator means.

15. Apparatus in accordance with claim 1 further including sensor means for sensing changes in surface or subsurface well conditions (e.g. temperature, pressure) and providing a signal in response thereto.

16. Apparatus in accordance with claim 15 further including control means responsive to said signals from said sensor means for operating said means for heating to control heating of said first and second actuator means.

17. A subsurface well safety valve apparatus comprising:

means defining an elongate substantially tubular housing adapted at each end for connecting to and communicating with sections of well tubing, valve means mounted within said housing and therein alternatable between an open condition for enabling fluid conduction through the bore of said tubular housing and a closed condition for blocking fluid conduction therethrough, means mounted within said housing for selectively opening and closing said valve means including opposing first and second actuator means, each including a shape memory alloy material which undergoes complementary shape transformations when respectively heated to or above or cooled below a predetermined temperature corresponding to the transition temperature of the shape memory alloy and each having a pair of ends, one end engaging said housing, said means for opening and closing further including means interconnecting the respective other ends of said opposing first and second actuator means and said valve means and being shiftable between a first valve open position and a second valve closed position, and means for heating said first actuator means to or above its predetermined temperature while said second actuator means is cooled below its predetermined temperature for transforming said respective actuators to shift said interconnecting means to its first position to open said valve means and means for heating said second actuator means to or above its predetermined temperature while said first actuator means is cooled below its predetermined temperature for transforming said respective actuators to shift said interconnecting means to its second position to close said valve means, sensor means for sensing changes in surface or subsurface well conditions (e.g., temperature, pressure) and providing a signal in response thereto, and control means responsivie to said signals from said sensor means for operating said means for heating to control heating and cooling of said first and second actuator means.

18. A subsurface well safety valve apparatus comprising:

means defining an elongate substantially tubular housing adapted at each end for connecting to and communicating with sections of well tubing, valve means mounted within said housing and therein alternatable between an open condition for enabling fluid conduction through the bore of said tubular housing and a closed condition for blocking fluid conduction therethrough, and means mounted within said housing for selectively opening and closing said valve means including opposing first and second helical spring actuator means substantially axially aligned within said housing above said valve means and each including a shape memory alloy material which undergoes complementary shape transformations when respectively heated to or above or cooled below a predetermined temperature corresponding to the transition temperature of the shape memory alloy and each having a pair of ends, one end engaging said housing, said means for opening and closing further including means interconnecting the respective other ends of said opposing first and second helical spring actuator means and said valve means and being shiftable between a first valve open position and a second valve closed position, means for heating said first actuator means to or above its predetermined temperature while said second actuator means is cooled below its predetermined temperature for transforming said respective actuators to shift said interconnecting means to its first position to open said valve means and means for heating said second actuator means to or above its predetermined temperature while said first actuator means is cooled below its predetermined temperature for transforming said respective actuators to shift said interconnecting means to its second position to close said valve means, and helical spring bias means mounted within said housing and having one end engaging said housing, and means interconnecting the other end of said spring bias means and said valve means for urging said valve means to maintain a closed condition when the temperature of said first actuator means drops below said predetermined level.

* * * * *